United States Patent [19]

Fisk et al.

[11] Patent Number: 4,907,783

[45] Date of Patent: Mar. 13, 1990

[54] CHAIN LINK FENCE EDGING AND TRIMMING ATTACHMENT

[76] Inventors: Phillip L. Fisk; Beth A. Fisk, both of 1920 W. 61st Pl. South, Tulsa, Okla. 74132-1366

[21] Appl. No.: 232,177

[22] Filed: Aug. 15, 1988

[51] Int. Cl.[4] ..... B21F 27/00

[52] U.S. Cl. ..... 256/32; 256/1; 256/33; 52/718.1; 47/33; 403/294

[58] Field of Search ..... 256/32, 33, 1, 26, 66; 47/32, 33; 403/294, 295; 52/102, 716, 718.1; 16/DIG. 13, 225

[56] References Cited

U.S. PATENT DOCUMENTS

| | | | |
|---|---|---|---|
| 3,195,863 | 9/1963 | Korecky et al. | 256/1 |
| 3,676,952 | 7/1972 | Watts | 256/32 X |
| 3,713,624 | 1/1973 | Kiemann | 256/32 |
| 3,768,780 | 10/1973 | Cowles et al. | 256/1 |
| 3,806,096 | 4/1974 | Eccleston et al. | 256/32 |
| 3,822,864 | 7/1974 | Keys | 256/32 |
| 4,074,479 | 2/1978 | Krupka | 52/102 |
| 4,478,391 | 10/1984 | Kovach | 256/1 |
| 4,493,583 | 1/1985 | Wallace | 403/402 |
| 4,497,472 | 2/1985 | Johnson | 256/32 |
| 4,515,349 | 5/1985 | Groves | 256/1 |
| 4,548,388 | 10/1985 | Cobler | 256/32 |
| 4,595,175 | 6/1986 | Kauffman et al. | 256/1 |
| 4,690,382 | 9/1987 | Koperdak | 256/32 X |

FOREIGN PATENT DOCUMENTS

| | | | |
|---|---|---|---|
| 220652 | 3/1959 | Australia | 287/189.36 D |
| 1007683 | 10/1965 | United Kingdom | 16/225 |

*Primary Examiner*—Randolph A. Reese
*Assistant Examiner*—Franco S. DeLiGuori

[57] ABSTRACT

A chain link fence lower edging strip which comprises an extruded flat strip of plastic having a pair of centrally molded parallel groove that form precreased hinges allowing the extruded strip to be placed under a lower edge of a chain link fence and then folded upwardly into a U-shaped configuration. The outer top edges of the folded plastic strip are continuous molded fasteners that lockingly engage to a plurality of connectors passing through the openings in wire mesh of the chain link fence. Such a lower fence liner is useful in allowing grass to grow up to the wire mesh yet be readily trimmed by a twirling line trimmer without deleterious breakage of the twirling line.

9 Claims, 3 Drawing Sheets

CHAIN LINK FENCE EDGING AND TRIMMING ATTACHMENT

BACKGROUND OF THE INVENTION

1. Field of the Invention:

The present invention relates to an edging and trimming attachment for the lower edge of a chain link fence that allows a line trimmer to cut grass up to the fence without consuming excess line. More specifically, the invention relates to an extended plastic profile that can be folded under and along the bottom edge of a chain link fence held there by a series of snap fasteners or connectors thus forming a resilient surface against which the line of a line trimmer can impinge without causing excess line wear or breakage.

2. Description of the Prior Art:

The concept of providing the lower edge of a chain link fence with a so-called fence liner or fence guard which will serve as a vegetation barrier that inhibits or prevents the growth of grass to the base of the fence is generally known. Various devices have been proposed in the past to accomplish the above. The prior art devices usually involve a flat horizontal surface that spreads out on both sides of the bottom of the fence and thus physically prevents the growth of vegetation at the fence. Such devices are usually difficult to install, particularly when approaching or going around a fence post or the like. Also, frequently such devices are expensive and labor intensive during installation.

It is also generally known that the use of the modern line trimmer, wherein a spinning nylon or plastic line is used as the cutting blade, along the bottom edge of a chain link fence tends to cut and break the twirling line resulting in excess consumption of line. Yet, a well manicured lawn with the grass trimmed up to the bottom edge of the chain link fence and no growth within the weave of the fence is frequently considered to be the most aesthetically pleasing option. As such, the need for a fence liner or guard that is inexpensive and readily compatible with a conventional chain link fence and that allows for the grass to grow right up to the fence bottom yet also allows for convenient trimming with a line trimmer still exists.

SUMMARY OF THE INVENTION

The present invention provides a continuous extended plastic profile which is either extruded in a folded configuration or precreased such as to fold under and around the lower edge of a conventional chain link fence or the like and extend up both sides of the wire mesh. The upper edges (the outer edges of the extruded profile) are further provided with continuous fastening means that engages a plurality of connector means that extend through the wire mesh and thus hold the folded plastic profile to the lower edge of the fence.

Preferably, the region on or near the bottom of the fence liner when folded is perforated to allow trapped water to escape. Optionally, either a single crease or a pair of parallel creases employed to fold the liner under the fence wire are such that the plastic will tear at the crease(s) at the discretion of the party installing the device providing for an open bottom where necessary. In the case of the open bottom, a second set of continuous fastening means is preferably provided in the sidewalls near the precreased lower edge such as to provide rigidity and a second plurality of connector means through the wire mesh of the chain link fence. Preferably, the continuous fastening means and plurality of connecting means are designed such that connector means can be installed or engaged arbitrarily anywhere along and between the extruded continuous fastener means and once engaged will exhibit freedom of movement along the fastener. In this manner, the chain link fence edging and trimming attachment according to the present invention is easily and readily installed on various size wire mesh and once installed, will readily accommodate varying degrees of tension and stretch of the fence as well as movement or motion of the fence.

Thus, the present invention provides a novel chain link fence lower edging strip comprising:

(a) an elongated substantially flat strip of extruded plastic adapted to fold about the bottom of the wire mesh of a chain link fence and extend vertically upward, during use, from the bottom of the fence wherein the flat strip of extruded plastic has at least one groove of reduced thickness extruded longitudinally substantially along the middle of the flat strip and thus forming at least one precreased hinge for forming a substantially U-shaped configuration during use and wherein the outer edges of the flat strip of extruded plastic form a pair of substantially continuous profile fastener means for engaging a plurality of connector means that hold the flat strip of extruded plastic in a folded U-shape configuration during use; and (b) a plurality of connector means, each of a length substantially corresponding to the thickness of the wire mesh of a chain link fence and each having a pair of fasteners at opposite ends compatible with locking engagement to the continuous profile fastener means extruded on the outer edges of the flat strip of extruded plastic, for insertion through the opening in the wire mesh of a chain link fence and for simultaneous engaging to the pair of continuous profile fastener means for holding the flat strip of extruded plastic in a folded U-shaped configuration during use.

In one specific embodiment, the chain link fence lower edging strip according to the present invention further comprises a pair of substantially parallel grooves of reduced thickness extruded longitudinally substantially along the middle of the flat strip and spaced apart by a distance corresponding to the thickness of the wire mesh fence, thus forming a pair of precreased hinges for forming a substantially U-shaped configuration during use. In another related specific embodiment of the chain link fence lower edging strip, a second pair of continuous profile fastener means for engaging the plurality of connector means is provided in the flat strip of extruded plastic, each of the second pair of continuous profile fastener means being located an equal distance above each of the pair of substantially parallel grooves, respectively, during use.

It is an object of the present invention to provide an inexpensive edging strip that can be readily installed on the lower portion of the wire mesh of a conventional chain link fence or the like. It is a further object of the present invention to provide such an edging strip that will suppress the growth of vegetation directly in the wire mesh and will allow trimming of the grass by the use of a twirling line trimmer directly against the lower portion of the fence without causing excess usage and breakage of the twirling line. It is still a further object of the present invention to provide such an edging strip that is compatible with varying size of openings and degrees of tension or stretch associated with the wire mesh as well as compatible with any movement or motion occurring in the fence. Fulfillment of these objects and the presence and fulfillment of other objects will be apparent upon complete reading of the specification and claims taken in conjunction with the attached drawings.

DESCRIPTION OF THE PREFERRED EMBODIMENTS

Figure 1:
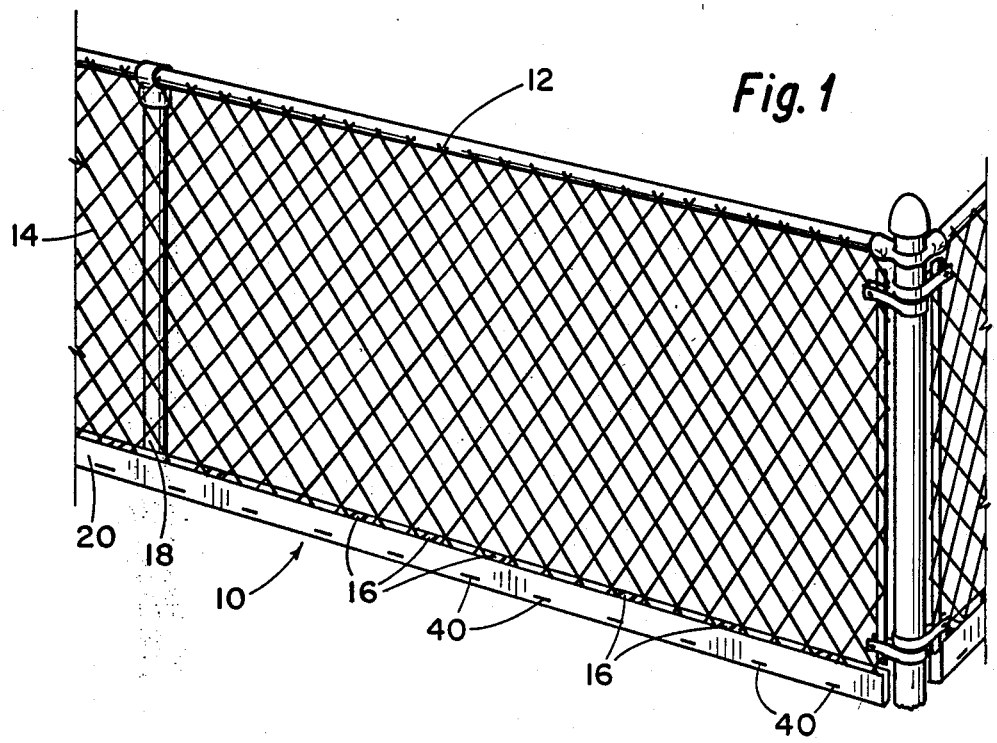
FIG. 1 illustrates a conventional chain link type fence with the edging strip according to the present invention installed at the bottom of the wire mesh.

The improved chain link fence edging strip according to the present invention, how it differs from the prior art and the advantages and benefits of the present invention can perhaps be best explained and understood by reference to the drawings. As can be seen in FIG. 1, the edging strip according to the present invention, generally designated by the numeral 10, attaches to the bottom portion of a conventional chain link fence 12. The edging strip 10, during use, folds around the bottom portion of the wire mesh 14 of the fence 12 and is held in a U-shaped configuration by a series of connectors 16. As such, the edging strip 10 readily passes by the fence post 18 with essentially no alteration or use of extra components or parts other than those used to assemble the conventional chain link fence. In describing the preferred embodiments of the present invention the description is directed primarily to a conventional chain link type fence. However, it should be appreciated that the edging strip of the present invention is also compatible with other types of open weave wire fence and the like and as such the term chain link should not be interpreted for the purposes of this invention as being unduly limiting.

Figure 2:
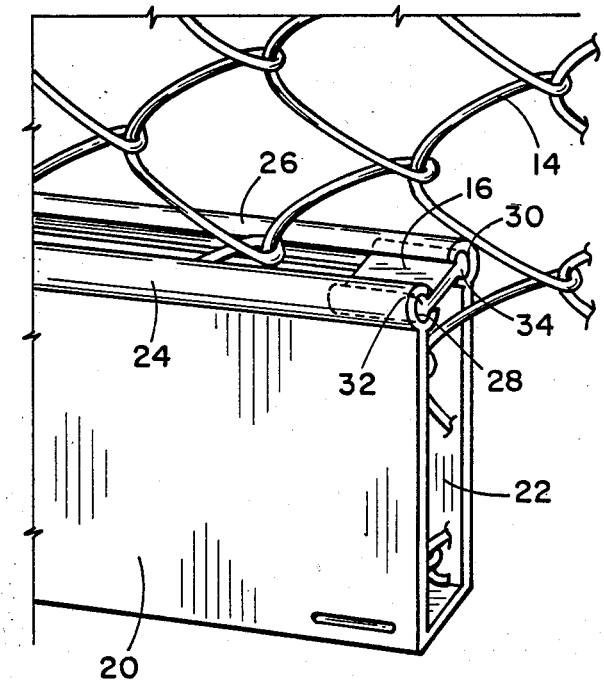
FIG. 2 is a cross-sectional close up perspective view of the edging strip of FIG. 1 installed on a chain link type fence.

As further illustrated in FIG. 2, the edging strip, during use, is folded around the bottom portion of the wire mesh 14 forming sidewalls 20 and 22 that extend upwardly along the bottom few inches of the wire mesh 14. Since the edging strip 10 is essentially a single plastic extruded profile, the sidewalls 20 and 22 are preferably soft and pliable, thus representing a resilient surface against which the nylon line of a so-called WEED-EATER type trimmer can impinge without damaging either the edging strip 10 or the twirling nylon line. As seen in FIG. 2 the upper edge of sidewalls 20 and 22 terminate in what is referred to for purposes of this invention as a pair of continuous profile fastener means 24 and 26. In the specific embodiment shown in FIG. 2, the continuous profile fastener means 24 and 26 are extruded plastic channels or recess 28 and 30 positioned along the outer edge (top of sidewalls) of the edging strip 10 with the openings of the channels 28 and 30 facing each other when the edging strip 10 is folded around the wire mesh 14. The connectors 16 are small elements that, during use, insert through the openings in the wire mesh 14 and engage with or lock within the channels 28 and 30.

Figure 11:
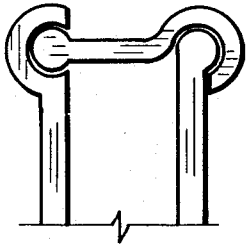

Each connector 16 is of a length substantially corresponding to the thickness or width of the wire mesh 14. Each of the opposite ends of the connector 16 terminate in a fastener 32 and 34 that is compatible with establishing a locking engagement to one of the continuous profile fastener means 24 or 26. Again in the specific embodiment illustrated in FIGS. 1 through 4, the connector 16 terminates in a circular cross sectional bulb that can be forced into the channel or recess in the continuous fastener means. In this manner, the connector 16 can be inserted through an opening in the wire mesh 14 and one end of the connector can be inserted into channel 28 and the other end can be simultaneously snapped into locking engagement in the other channel 30. Thus, the connector 16 serves as a bridge member or element that holds the edging strip 10 in a folded U-shaped configuration. Furthermore, since the channels 28 and 30 are substantially continuous along the top edge of the edging strip 10, the fence can be stretched during installation or move during use without disrupting the edging strip. It should be appreciated for purposes of this invention that the circular cross section bulbs at either end of the connector 16 can be readily exchanged with the compatible locking profile of the channels 28 and still be operative. In other words, the channel can be on the connector and snap on to the circular cross-section on the top of the sidewall of the fence liner (see FIG. 11). Similarly, various alternative profiles can be employed as illustrated later. Furthermore, the substantially continuous fasteners may be periodically interrupted (discontinuous) provided sufficient length is provided for a plurality of connectors each with some degree of movement of approximately the dimensions of a few openings in the wire mesh.

Figure 3:
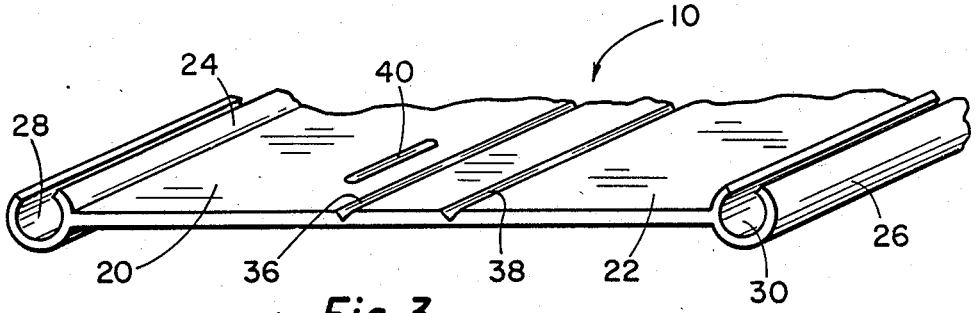
FIG. 3 is a perspective view of the edging strip of FIG. 1 in an unfolded configuration prior to installation on the fence.
Figure 4:
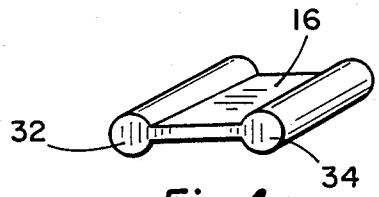
FIG. 4 is a perspective view of the connector clip used in conjunction with the edging strip of FIG. 3.

FIG. 3 shows the edging strip 10 as a substantially flat continuously extruded plastic profile of arbitrary length, prior to being installed on the chain link fence. It should be appreciated that the extruded profile does not have to be flat but could be extruded in a U-shape or the like such as to slip under the bottom of the fence. The edging strip 10 is preferably fabricated out of an extruded thermoplastic polymer or plastic such as a polyolefin (i.e., polypropylene or polyethylene); however, other extrudable thermoplastic as generally known in the art can also be employed. As seen in FIG. 3, the flat edging strip 10 preferrably has a pair of parallel grooves 36 and 38 centrally located along the strip; however, a single groove could be employed particularly since the preferred polymers are relatively flexible. The grooves 36 and 38 are spaced apart at a distance that corresponds to the nominal thickness or width of the wire mesh. In this manner, the grooves act as precreased hinges about which the extruded flat strip can be folded. Also as seen in FIG. 3, a series of perforations or holes 40 are present along or adjacent to the grooves. These holes serve to drain trapped water from between the sidewalls of the edging strip when installed to a fence.

Figure 5:
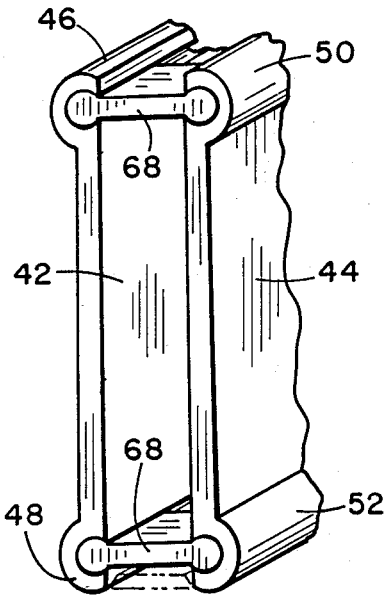
FIGS. 5 and 6 illustrate cross sectional view of alternate embodiments of the chain fence edging strip according to the present invention.
Figure 6:
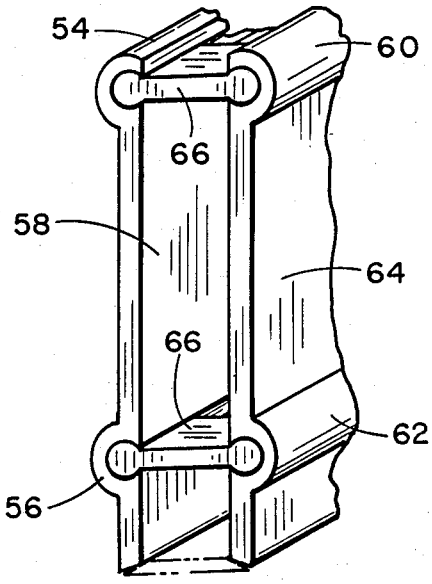
Figure 10:
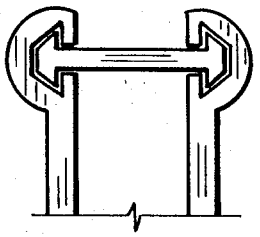
FIGS. 7 through 14 illustrate alternate structural configurations for continuously fastening the upper edges of the edging strip according to the present invention through the wire mesh of the chain link fence.
Figure 9:
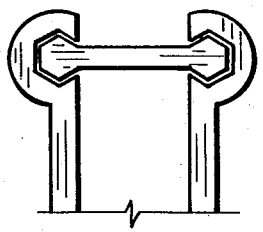
Figure 8:
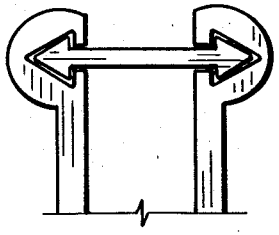
Figure 7:
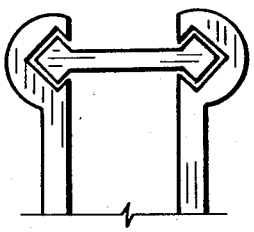
Figure 14:
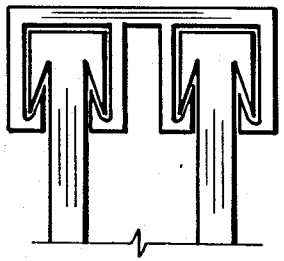
Figure 13:
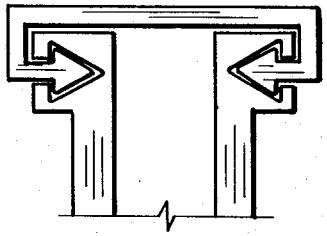
Figure 12:
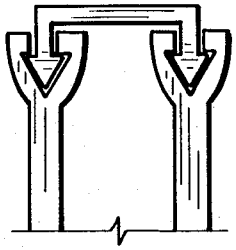

FIGS. 5 and 6 illustrate alternate embodiments of the edging strip according to the present invention. In both of these alternate embodiments, the respective sidewalls of the edging strip have two continuous profile fastener means extending longitudinally along each sidewall.

Thus, in FIG. 5, the sidewalls 42 and 44 each have a pair of continuous fasteners 46 and 48 and 50 and 52, respectively. Similarly, the embodiment of FIG. 6 has a pair of continuous fasteners 54 and 56 on sidewall 58 and a pair of continuous fasteners 60 and 62 on sidewall 64. Again, connector elements 66 and 68 are employed to interlock from sidewall to sidewall, thus holding the sidewalls to the wire mesh of the chain link fence. The embodiments of FIGS. 5 and 6 differ further from the embodiment of FIGS. 1 through 4 in that the bottom of the edging strip is open and no plastic present to suppress growth of vegetation directly between the sidewalls within the wire mesh. The embodiments of FIGS. 5 and 6 differ from each other in that the sidewall of FIG. 6 extends further downward than that of FIG. 5. The open bottom feature of FIGS. 5 and 6 can be achieved either by originally extruding the sidewalls as separate pieces or in the alternative, the pair of parallel grooves shown in FIG. 3 can be selected such that the center material can be removed at the time of installation, e.g., all dashed lines in FIGS. 5 and 6. Intentionally extruding the flat edging strip such that the parallel grooves can act as either a hinge or a locator to cut out the center portion when more than one continuous fastener means per sidewall is present allows for greater versatility during installation, particularly when the chain link fence is already erected and the bottom of the wire is embedded in the soil or the like. In the case of an open bottom application of the present invention, the use of herbicides between the sidewalls can be facilitated by having one sidewall extend higher than the other.

It should be further appreciated that various physical configurations and geometries can be employed in the present invention with respect to the profile of the continuous fastener means and the interlocking connector bridge. FIGS. 7 through 14 illustrate alternate structural configurations for continuously fastening the edges of the sidewalls through the chain link wire mesh. In each of these alternate embodiments, the connector means with fasteners at opposite ends can be inserted arbitrarily anywhere along the extruded continuous fastener means and once inserted or interlocked, can slide or reposition itself therein. This in turn allows the wire mesh to be stretched during installation and move after installation without affecting the edging strip.

Preferably, the connector means is manufactured out of a plastic or structurally strong material. Because of the cross-sectional symmetry of the openings or channels associated with the continuous fastener means, the connector means can also be manufactured as an extruded profile and then cut into individual connectors that fit through the openings in the wire mesh. As such, the overall cost of producing the edging strip and connectors according to the present invention can be held to a minimum.

Having thus described the invention with a certain degree of particularity, it is to be understood that the invention is not limited to the embodiments set forth herein for purposes of exemplification, but is to be limited only by the scope of the attached claims, including a full range of equivalents to which each element thereof is entitled.

We claim:

1. A chain link fence lower edging strip comprising:

(a) an elongated substantially flat strip of extruded plastic adapted to fold about the bottom of the wire mesh of a chain link fence and extend vertically upward, during use, from the bottom of the fence wherein said flat strip of extruded plastic has at least one groove of reduced thickness extruded longitudinally substantially along the middle of said flat strip and thus forming at least one precreased hinge for forming a substantially U-shaped configuration about the bottom of the wire mesh of a chain link fence during use and wherein the outer edges of said flat strip of extruded plastic form a pair of substantially continuous profile fastener means for engaging a plurality of connector means that hold said flat strip of extruded plastic in a folded U-shape configuration during use; and (b) a plurality of connector means, each of a length substantially corresponding to the thickness of the wire mesh of a chain link fence and each having a pair of fasteners at opposite ends compatible with locking engagement to said continuous profile fastener means extruded on the outer edges of said flat strip of extruded plastic, for insertion through the opening in the wire mesh of a chain link fence and for simultaneous engaging to said pair of continuous profile fastener means for holding said flat strip of extruded plastic in a folded U-shaped configuration during use for adjustably sliding along said continuous profile fastener means during use to accommodate movement of a chain link fence.

2. A chain link fence lower edging strip of claim 1 further comprising a pair of substantially parallel grooves of reduced thickness extruded longitudinally substantially along the middle of said flat strip and spaced apart by a distance corresponding to the thickness of the wire mesh fence thus forming a pair of precreased hinges for forming a substantially U-shaped configuration during use.

3. A chain link fence lower edging strip of claim 2 wherein a second pair of continuous profile fastener means for engaging said plurality of connector means is provided in said flat strip of extruded plastic, each of said second pair of continuous profile fastener means being located an equal distance above each of said pair of substantially parallel grooves, respectively, during use.

4. A chain link fence lower edging strip of claim 3 wherein said pair of substantially parallel grooves are sufficiently sized to allow selective removal of that portion of said flat strip located therebetween.

5. A chain link fence lower edging strip comprising:

(a) an elongated substantially flat strip of extruded plastic adapted to fold about the bottom of the wire mesh of a chain link fence and extend vertically upward, during use, from the bottom of the fence wherein said flat strip of extruded plastic has at least one groove of reduced thickness extruded longitudinally substantially along the middle of said flat strip and thus forming at least one precreased hinge for forming a substantially U-shaped configuration during use and wherein the outer edges of said flat strip of extruded plastic form a pair of substantially continuous profile fastener means for engaging a plurality of connector means that hold said flat strip of extruded plastic in a folded U-shape configuration during use and wherein the middle portion of said flat strip of extruded plastic near said groove is perforated to allow water to escape during use; and (b) a plurality of connector means, each of a length substantially corresponding to the thickness of the wire mesh of a chain link fence and each having a pair of fasteners at opposite ends compatible with locking engagement to said continuous profile fastener means extruded on the outer edges of said flat strip of extruded plastic, for insertion through the opening in the wire mesh of a chain link fence and for simultaneous engaging to said pair of continuous profile fastener means for holding said flat strip of extruded plastic in a folded U-shaped configuration during use.

6. A chain link fence lower edging strip comprising:

(a) an elongated substantially flat strip of extruded plastic adapted to fold about the bottom of the wire mesh of a chain link fence and extend vertically upward, during use, from the bottom of the fence wherein said flat strip of extruded plastic has a pair of substantially parallel grooves of reduced thickness extruded longitudinally substantially along the middle of said flat strip and spaced apart by a distance corresponding to the thickness of the wire mesh fence thus forming a pair of precreased hinges for forming a substantially U-shaped configuration during use and wherein the middle portion of said flat strip of extruded plastic near said groove is perforated to allow water to escape during use; and (b) a plurality of connector means, each of a length substantially corresponding to the thickness of the wire mesh of a chain link fence and each having a pair of fasteners at opposite ends compatible with locking engagement to said continuous profile fastener means extruded on the outer edges of said flat strip of extruded plastic, for insertion through the opening in the wire mesh of a chain link fence and for simultaneous engaging to said pair of continuous profile fastener means for holding said flat strip of extruded plastic in a folded U-shaped configuration during use.

7. A chain link fence lower edging strip of claim 6 wherein a second pair of continuous profile fastener means for engaging said plurality of connector means is provided in said flat strip of extruded plastic, each of said second pair of continuous profile fastener means being located an equal distance above each of said pair of substantially parallel grooves, respectively, during use.

8. A chain link fence lower edging strip of claim 7 wherein said pair of substantially parallel grooves are sufficiently sized to allow selective removal of that portion of said flat strip located therebetween.

9. A chain link fence edging strip comprising:

(a) a first elongated substantially flat strip of extruded plastic containing at least two substantially continuous profile fastener means for engaging to a plurality of connector means;

(b) a second elongated substantially flat strip of extruded plastic containing at least two substantially continuous profile fastener means for engaging to a plurality of connector means; and (c) a plurality of connector means each having a pair of fasteners at opposite ends of said connector means wherein one fastener at one end of a connector means reversibly engages to and disengages from one of said continuous profile fastener means of said first flat strip of extruded plastic while simultaneously the other fastener at the other end of said connector means reversibly engages to and disengages from one of said continuous profile fastener means of said second flat strip of extruded plastic and when engaged at both ends said connector means is adjustably slidably along said continuous profile fastener means.

* * * * *